US005152416A

United States Patent [19]

Cassel

[11] Patent Number: 5,152,416

[45] Date of Patent: Oct. 6, 1992

[54] CONTAINER WITH LID SEAL

[75] Inventor: Timothy Cassel, Boxborough, Mass.

[73] Assignee: Tucker Housewares, Inc., Leominsterm, Mass.

[21] Appl. No.: 816,842

[22] Filed: Dec. 31, 1991

Related U.S. Application Data

[63] Continuation of Ser. No. 639,057, Jan. 9, 1991, abandoned.

[51] Int. Cl.[5] ..... B65D 41/06

[52] U.S. Cl. ..... 220/288; 220/296; 220/DIG. 25; 220/355; 215/354

[58] Field of Search ..... 215/341, 344, 270, 354, 215/320; 220/240, 288, 296, DIG. 25, 355, 356

[56] References Cited

U.S. PATENT DOCUMENTS

| | | | |
|---|---|---|---|
| 2,063,538 | 12/1936 | Dahl | 220/296 |
| 2,181,340 | 11/1939 | Plumb | 220/296 |
| 2,914,206 | 11/1959 | Lowen | 215/354 X |
| 3,482,725 | 12/1969 | Exton | 215/354 X |
| 3,540,612 | 11/1970 | Brady | 215/254 X |
| 3,831,798 | 8/1974 | Rowe et al. | 215/320 X |
| 4,674,644 | 6/1987 | Jacobs | 215/320 |
| 4,771,905 | 9/1988 | Perne et al. | 215/270 |
| 4,976,370 | 12/1990 | Cassel | 220/355 X |

*Primary Examiner*—Stephen Marcus
*Assistant Examiner*—Paul A. Schwarz
*Attorney, Agent, or Firm*—Darby & Darby

[57] ABSTRACT

A plastic container and lid both of resilient material with the container having spaced thread segments below its upper edge and the lid having a central section from which extends an outer sealing section with a curved upwardly sloping inner wall and thread segments on the inside of a skirt wall extending downwardly from the sealing section. Threading of the lid onto the container in a downward direction brings the inner periphery of the container upper edge into an increased contact with the lid sealing section curved upwardly sloping inner wall and the latter also exerts an outward radial force on the container wall to enhance the sealing action and which also tightens the engagement between the lid skirt and container wall in the areas of their mating threads.

8 Claims, 1 Drawing Sheet

CONTAINER WITH LID SEAL

This is a continuation of application Ser. No. 639,057, filed Jan. 9, 1991, now abandoned.

BACKGROUND OF THE INVENTION

Many types of plastic containers are used for various purposes, such as, for example, storing foods. These include types of containers which can be taken from the refrigerator and placed into a microwave oven. In any such container it is desired to provide an effective seal between the lid and the container itself. It is also desirable to provide an effective seal which can be achieved with the simplest possible structure since this reduces mold and manufacturing costs. Further, the lid should be easy to use, that is, easy to attach to and remove from the container.

Lid to container seals are usually made by providing the upper edge of the container with a protuberance which rides against or fits into a mating part on the lid. The seal is accomplished as the lid is fastened by a pressing or threading action. Many seals are accomplished by merely forcing the lid down over the top edge of the container, but in such arrangements it sometimes is difficult to remove the lid from the container by the prying action required.

BRIEF DESCRIPTION OF THE INVENTION

The present invention relates to a lid locking seal for a container in which the lid is secured to the container by mating threads. In accordance with the invention, there are thread segments on both the container and the lid skirt wall so that it takes only a part of a full turn of the lid relative to the container to achieve fastening of the lid to the container and effecting the seal. The top peripheral edge of the container, which generally is of the same thickness as the container wall and is rounded, engages the inner curved upwardly inclined wall of a generally U-shaped sealing area lid. The lid sealing area is shaped for mating engagement with the container wall's upper peripheral edge so that as the lid is fastened down onto the top of the container by the threading action, the container top peripheral edge engages the lid sealing area inner curved upwardly sloping wall and deforms it into a flatter shape providing a more extensive sealing area. At the same time, a more central part of the lid forces the lid sealing area inner curved upwardly sloping wall wall against the container upper edge and the container wall outwardly to make a tighter engagement between the container and lid mating threads. The dual action of the container peripheral edge flattening the lid inner wall sealing area and the lid inner wall pushing out on the container wall make an effective seal. All of this is accomplished with the lid being threaded for less than a full turn.

To remove the lid from the container, it is only necessary to unthread it, again only by turning it for less than a full turn. Accordingly, lid sealing and removal is accomplished in a quick and easy fashion.

OBJECTS OF THE INVENTION

It is therefore an object of the present invention to provide a lid and container in which the lid is threaded to the container and provides an effective seal by rotating the lid for less than one full turn.

Another object is to provide a container with a lid in which the lid has a U-shaped sealing area with an inner curved upwardly sloping wall and an outer wall, the top peripheral edge of the container engaging the inner wall of the lid sealing area and being brought into a tighter engagement and expanding its sealing area as the lid is fastened to the container.

A further object is to provide a container and lid in which an effective seal is formed with the upper edge of the container engaging a sealing wall area on the lid, the lid expanding the container wall outwardly to bring mating threads into tighter engagement.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
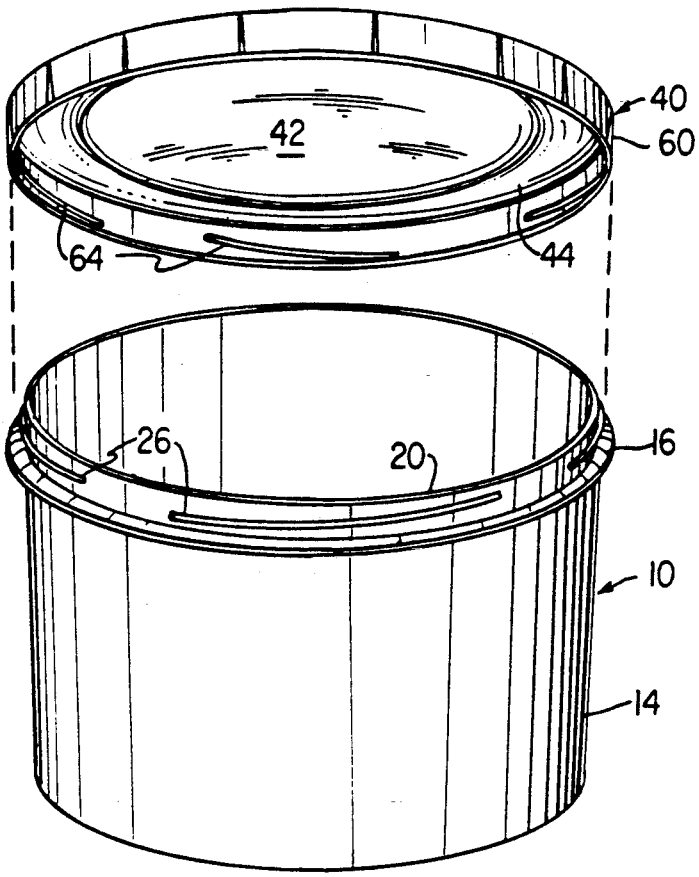
FIG. 1 is a perspective view of the container and lid, with the lid being separated from the container.

Referring to the drawings, the invention includes a plastic container 10 of any suitable material, e.g. polypropylene styrene, ABS plastic or other suitable material. The container can be of any size and is shown as having a generally cylindrical shape. The side wall 14 of the container shown is as being substantially vertical relative to its base 15 but there can be, if desired, a slight angle extending outwardly so that containers 10 can be at least partially nested one within the other.

A downwardly tapered peripheral rim 16 is provided near the top of container wall 14. The rim 16 sets the maximum downward travel extent for the lid and also a convenience finger hold for the user of the container.

The container peripheral top edge 20 is an extension of wall 14 and is of the same thickness. That is, it is not enlarged. The top peripheral edge 20 is rounded, i.e., it is curved on both sides and on the top.

Located on the upper portion of the wall 14 above the rim 16 are a plurality of spaced thread segments 26. Each thread segment 26 extends only partially around the outer surface of the container. As shown, there are four such thread segment 26, each having the same pitch and starting at the same height on the container wall and also ending at the same lower height. Each thread segment occupies about 50°–75° of the wall circumference. The number of thread segments and their angular extent can be selected as desired.

A lid 40 is provided having a central section 42 which is somewhat domed. The lid 40 is preferably formed of the same material as the container and is of about the same thickness as the wall 14. A hinge portion 44 extends upwardly from the outer edge of the lid domed central section 42 and continues on to a U-shaped sealing section 46 having an upwardly sloping inner wall 48 and downwardly sloping outer wall 50 connected by a U-shaped central area 52.

A skirt 60 extends downwardly from the sealing area section outer wall 50. The skirt 60 extends generally vertically and has a length such that it will not normally engage the container rim when the lid is fully fastened to the container (see FIG. 3).

Spaced thread segments 64 are formed near the lid skirt wall lower edge. The lid thread segments 64 are to mate with the thread segments near 26 the upper edge of the container wall. The lid thread segments 64 are complementary to the container thread segments 26. That is, they are of the same number, pitch, and spacing. Thus, the lid can be fastened to the container with no special orientation between the two being necessary. That is, there are as many starting points for the threading action as there are thread segments.

Due to the use of the thread segments 26 and 64, the lid can be fully fastened to the container with less than one full turn of the lid. In a preferred embodiment, the fastening action is accomplished in about one-third to one-half of a turn of the lid.

Figure 2:
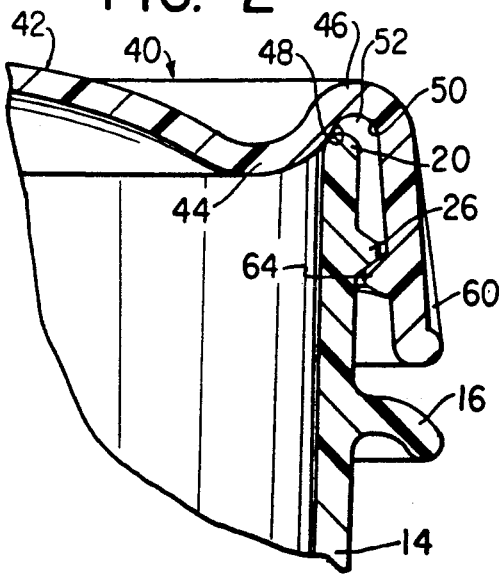
FIG. 2 is a partial elevational view in section of the lid engaging the container wall upper peripheral edge as it is first threaded onto the container.

FIG. 2 shows the lid thread segment 64 and the container thread segment 26 slightly past their starting engagement point as the lid is being rotated clockwise onto the container. FIG. 2 also shows the inside rounded part of the container upper edge 20 in initial contact with the lower part of the upwardly sloping inner wall 48 of the lid U-shaped sealing area.

Figure 3:
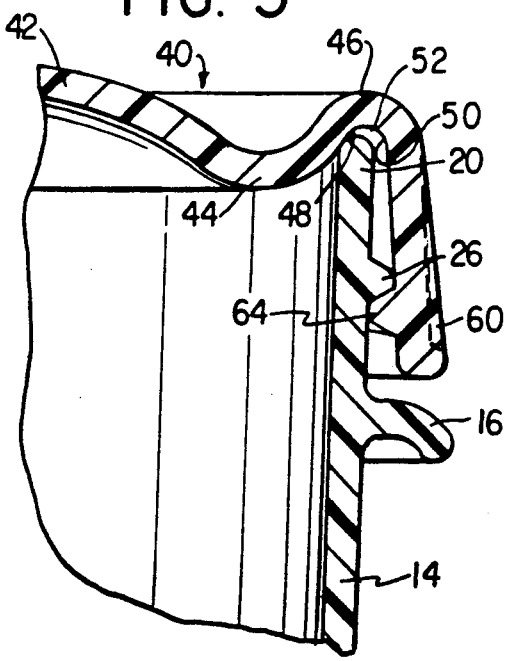
FIG. 3 is a view similar to FIG. 2 with the lid threaded further down onto the container wall upper peripheral edge.

FIG. 3 shows the condition where the lid 40 has been threaded clockwise further down on the container past its position in FIG. 2. The lid thread segments 64 have travelled downward on the container thread segments 26 bringing the lid downward on the container. The downward movement of the lid on the container also forces the rounded inner part of the container upper edge 20 to move higher up along the upwardly sloping lid sealing area inner wall 48 and this action can also make the inner wall 48 vertically flatter. As can be seen, the contact area between the inner rounded part of the container upper edge 20 and the sealing area inner wall 48 has increased. This provides an effective seal.

The seal is also made more effective by the lid sealing area inner wall 48 pushing outward on the container wall 14 with a radially equalized force. The radial outward push by the lid inner wall 48 also increases the area of contact between the inner rounded surface of the of the container wall peripheral edge 20 and the inner wall 48 of the U-shaped sealing area.

Any eccentricity of the container opening within its upper peripheral edge 20 is eliminated as the inner conical wedge hinge portion 44 of the lid radially displaces the container wall 14 outward and a tight contact between the sealing area inner wall 48 and the inside rounded edge of the container wall 20 is maintained around the entire circumference of the container wall.

Since the upper edge of the container wall is not reinforced, such as by a bead, the container wall can expand outwardly easier.

As the container wall is displaced radially outwardly, the container thread segments 26 are also forced outward into a more secure engagement with the lid thread segments 64. By employing all of the above features an effective seal is obtained.

The entire lid fastening and seal forming action is accomplished by rotating the lid for only about 60°–120°, depending upon the number, length and pitch of the thread segments 21, 64. This makes it easy for a user since a continuous threading action of one or two, full turns are unnecessary.

The lid is removed by rotating it in the reverse direction by the same amount as the fastening action. Thus, the lid is quickly removed and no prying action is necessary.

What is claimed is:

1. The combination of a container and lid comprising:

a container of resilient plastic material having a generally cylindrical upwardly extending wall with an upper edge;

a thread on the outer surface of the container wall adjacent and below its upper edge;

a lid of resilient plastic material having a central portion, an outer sealing section with a curved upwardly sloping inner wall extending from said central portion, and a skirt wall extending downwardly from said lid sealing section, a thread on the inner surface of the lid skirt to mate with the container wall thread, wherein threading of the lid onto the container wall as the lid is rotated downwardly on the container wall brings the lid sealing section curved upwardly sloping inner wall into increasingly further engagement with the inner periphery of the upper edge of the container wall and said curved upwardly sloping inner wall forcing the container upper edge and wall outwardly to increase the sealing contact between the container upper edge inner periphery and said lid curved upwardly sloping inner wall upon the further upward and outward movement of the inner periphery of the container wall upper edge relative to the lid curved upwardly sloping inner wall.

2. The combination of claim 1 wherein the inner periphery of the container wall upper edge in contact with the lid curved upwardly sloping inner wall is rounded.

3. The combination of claim 1 wherein the lid has a generally conical shaped hinge section between its central portion and the curved upwardly sloping inner wall of the lid sealing section, the lid hinge section exerting an outward radial force to force the lid curved upwardly sloping inner wall sealing section outwardly against the inner periphery of the container wall upper edge.

4. The combination of claim 3 wherein the outward radial force moves the container wall outwardly and its thread segments into firmer engagement with the lid thread segments.

5. The combination of claim 1 wherein the lid sealing section is formed by said curved upwardly sloping inner wall which terminates at one end of a U-shaped channel, and the lid skirt wall depending from the other end of the U-shaped channel.

6. The combination of claim 2, wherein the entire container wall upper edge is rounded.

7. The combination of claim 1, wherein the mating thread segments on the container wall and lid skirt wall provide full fastening of the lid to the container and sealing with less than one full rotational turn of the lid.

8. The combination of claim 1 when the thread on each of said container wall and lid are formed as spaced segments.

* * * * *